United States Patent [19]

Laird et al.

[11] Patent Number: 5,000,885

[45] Date of Patent: Mar. 19, 1991

[54] CHEMICAL INHIBITOR FOR SOLID PROPELLANTS

[75] Inventors: Janet L. Laird, Cuyahoga Falls; Roger J. Becker, Kettering; Ival O. Salyer, Dayton, all of Ohio

[73] Assignee: The United States of America as represented by the Secretary of the Air Force, Washington, D.C.

[21] Appl. No.: 46,742

[22] Filed: May 7, 1987

Related U.S. Application Data

[63] Continuation of Ser. No. 908,853, Sep. 18, 1986, abandoned.

[51] Int. Cl.[5] ..... C06B 21/00

[52] U.S. Cl. ..... 264/3.1; 149/109.6; 102/289; 102/290

[58] Field of Search ..... 102/289, 290; 149/109.6; 264/3.1

[56] References Cited

U.S. PATENT DOCUMENTS

| | | | |
|---|---|---|---|
| 3,012,507 | 12/1961 | Mosher et al. | 102/98 |
| 3,215,648 | 11/1965 | Duffy et al. | 260/2.5 |
| 3,493,446 | 2/1970 | Braun et al. | 149/109 |
| 3,999,382 | 12/1976 | Clifford et al. | 60/253 |
| 4,004,523 | 1/1977 | Clifford et al. | 102/103 |
| 4,183,841 | 1/1980 | Danowski | 260/38 |
| 4,441,942 | 4/1984 | Sayles | 102/290 |
| 4,536,235 | 8/1985 | Lelu et al. | 102/290 X |
| 4,590,860 | 5/1986 | Kromrey | 102/290 X |

*Primary Examiner*—Peter A. Nelson

*Attorney, Agent, or Firm*—Charles E. Bricker; Donald J. Singer

[57] ABSTRACT

Solid propellant test strands are inhibited, i.e., prevented from burning in an uncontrolled fashion, by coating the strands with a liquid composition containing a partially cured phenolformaldehyde in a volatile solvent, then volatizing the solvent.

10 Claims, No Drawings

CHEMICAL INHIBITOR FOR SOLID PROPELLANTS

RIGHTS OF THE GOVERNMENT

The invention described herein may be manufactured and used by or for the Government of the United States for all governmental purposes without the payment of any royalty.

This is a continuation of application Ser. No. 06/908,853, filed Sept. 18, 1986, and now abandoned.

BACKGROUND OF THE INVENTION

Both rocket moor design and propellant design are aided by detailed in-situ information on the deflagration behavior of propellant surfaces present understanding of the details of propellant combustion is however, sparse. More must be learned about localized, transient burning rates, their dependence on grain and binder composition and grain size distribution, and the coupling or regression rates of the various constituents in the grain.

Solid propellants generally have a granular, heterogeneous composition. The particle sizes of the various constituents generally range from 2 to 1000 microns, the largest being oxidizers. Consequently, local variations in transient burning rates of these constituents are expected. A spiked behavior in the local burning rate is known to occur in many propellants. During test burns in a combustion chamber, these local transients can couple to the acoustic field in the chamber, causing oscillation of the burning rate, further acoustically driving instabilities in the chamber.

High-speed photographic recording of a propellant burn in a combustion chamber is considered to be a valuable tool both for propellant formulation and for motor design. Much of the present knowledge of propellant deflagration has been garnered by high-speed photoqraphy.

Because of the need and/or desire for magnification of the image, the depth of field of such high-speed cinematography can be very limited. If the position of the propellant grain or strand is fixed during a burn sequence, the number of in-focus frames is limited by the limited depth-of-field. This drawback can be overcome, at least in part, by employing a servopositioner to advance the burning propellant to maintain the desired burning surface within the limited depth-of-field of the recording apparatus.

Solid rocket propellant has a tendency to burn along all exposed surfaces, a phenomenon known as flashing. Consequently, a strand forms a pointed surface during deflagration. Because of the limitations in photographic equipment, the desired burning surface is a flat plane. Preferably parallel to the film plane and at an angle with respect to the length of the strand. Several methods have been employed to inhibit flashing. One method, commonly used, is simply to briefly soak the strand in water immediately prior to deflagration. However, if the water is applied more than a few minutes before deflagration, its ability to inhibit flashing is greatly reduced. Therefore water cannot be used for any runs where the propellant must be prepared much in advance of deflagration. Silicone grease has been employed as an inhibitor but it does not fully prevent the sides of the strand from burning. The silicone grease also releases considerable smoke during deflagration, thereby interfering with photographic recording.

Accordingly it is an object of the present invention to provide a method for inhibiting burning on at least a portion of the exposed surface of a specimen of solid rocket propellant during deflagration.

Other objects and aspects of this invention will be apparent to those skilled in the art.

DESCRIPTION OF THE INVENTION

In accordance with the present invention there is provided a method for inhibiting burning on at least a portion of the surface area of a specimen of a solid rocket propellant which comprises coating said portion with a solution of a partially polymerized phenol-formaldehyde polymer in a solvent and removing the solvent.

The composite propellants to which this method applies are formed of a major amount of solid particles of an inorganic oxidizer and a fuel uniformly distributed throughout a matrix or binder. Such oxidizers generally include the nitrates, chlorates and perchlorates of the alkali metals, alkaline earth metals and ammonia. Fuels include aluminum, magnesium, beryllium, and others. Suitable binders include the synthetic rubbers based on the copolymers of polybutadiene with acrylic acid, methacrylic acid, vinylidene chloride or the like, the chemical rubbers of the polyurethane type and mixtures of fluorocarbons such as polytetrafluoroethylene and the copolymer of vinylidene fluoride and perfluoropropylene. Composite propellant compositions also normally contain combustion modifiers or burning rate catalysts, plasticizers, stabilizers and the like.

Although the present invention is hereinafter discussed and exemplified with respect to propellant test samples or strands, the invention is also applicable for inhibiting full-size solid propellant rocket motors or grains.

Propellant sample test burns are carried out inside a burning chamber of suitable configuration. For example, such a chamber may have a transparent port through which progress of the burn can be photographed, together with means for holding and advancing the propellant sample, means for igniting the sample means for illuminating the sample, and the like. The burning chamber, as such, does not form a part of the present invention and is therefore neither illustrated nor further described herein.

Test strands of the propellant can be prepared in various ways. Cast-type propellants can be cast into a sheet of suitable thickness, cured and then cut into square strands. Double-base propellants may be molded into sheet form, then cut into strands, or they may be extruded into strands.

The propellant test strands are inhibited by coating the outer surface with a liquid mixture consisting essentially of a partially cured phenol-formaldehyde resin dissolved in a suitable solvent and, optionally, a plasticizer, a toughening agent and/or an antioxidant. The concentration of resin in the solvent is about 10 to 65, preferably about 15 to 40, grams of resin per 100 ml of solvent. This liquid mixture is coated onto the test strand by dipping, brushing or the like. The solvent is then evaporated away from the coated strand. Depending upon the particular solvent employed, such evaporation may be accelerated by applying an elevated temperature or a reduced pressure, or both, so long as the temperature remains below the curing temperature of the resin and the ignition temperature of the propellant. When the solvent is substantially completely evaporated off, the propellant strand may be placed in storage or tested immediately. Immediately prior to testing, a test surface is exposed by cutting away a portion of the coated strand.

The inhibiting resin is a partially cured phenol-formaldehyde resin. It is known that in the presence of an acid or a base, phenol and aqueous formaldehyde react to form a solution of phenolic alcohols or methylol derivatives with the methylol groups in the ortho and para positions. The methylol phenols formed initially in a basic medium with formaldehyde in excess condense with each other and with additional formaldehyde to provide an "A-stage" resin or "resole", a brittle resin which is soluble and fusible. The resole resin consists of a mixture of isomers containing free methylol groups, which are available for subsequent cross-linking reactions to form a less-soluble "B-stage" resin.

In the presence of acid and less than 0.86 mole of formaldehyde per mole of phenol, the primary alcohols react to yield diphenylmethane polymers called "novolacs", which are soluble and fusible and contain about 5–6 phenol units per molecule These resins are also referred to as A-stage resins Hardening of all these is effected by further cross-linking. A resole-type resin is capable of cross-linking itself on heating, while a novolac has no free methylol groups and must be mixed with an aldehyde to undergo further reaction.

The phenol component of the aforedescribed condensate can be unsubstituted or mono-, di-, or tri-substituted, preferably at most di-substituted, with groups selected from the class consisting of hydroxyl; halogen, e.g., Cl and Br; alkyl, e.g., methyl, propyl, butyl, hexyl, octyl, nonyl, decyl, dodecyl; alkenyl, e g., propenol, butenyl, decenyl; cycloalkyl, e.g., cyclopentyl, cyclohexyl; aryl, e.g., phenyl, naphthyl; carboxy, carboxy alkyl, and carboxy alkenyl in acid form or esterified with an alkyl, alkenyl or phenyl group; alkoxy, e.g., methoxy, butoxy, octoxy; alkenyloxy, e.g., allyloxy; phenoxy.

Examples of suitable substituted phenols include; resorcinol, hydroquinone, pyrocatechol, phloroglucinol, o- and p-chlorophenol, 2,5-dichlorophenol, 4-chloro-3-methylphenol, 4-chloro-3,5-dimethylphenyl, o- m- and p-cresol p-butyl phenol p-tert-amyl phenol p-nonyl phenol, 6-tert-butyl-m-cresol, 5-ethyl-m-cresol thymol, carvacol, 3,4-dimethyl phenol, 3-hydroxy-5-methyl phenol, p-allyl phenol, isoeugenol, o- and p-phenylphenol, p-hydroxy benzoic acid, 5-hydroxyisophthalic acid, 2-hydroxy-3-methylbenzoic acid, methyl and ethyl p-hydroxy-benzoate, methyl, ethyl, isoamyl and phenyl salicylate, o-hydroxy cinnamic acid; ethyl o-hydroxycinnamic acid p-hydroxy-phenylacetic acid butyl p-hydroxyphenylacetate, o- and p-methoxy phenol, o- and p-phenoxyphenol.

The condensing component can be any aldehyde which will condense with the particular phenol being used including formaldehyde, acetaldehyde, propionaldehyde, butraldehyde, heptaldehyde, benzaldehyde, nuclear alkyl-substituted benzaldehydes, such as toluic aldehyde, etc., naphthaldehyde, etc., furfuraldehyde, glyoxal, acrolein, etc., or compounds capable of engendering aldehydes such as paraformaldehyde, hexamethylenetetramine, etc.

In general the preferred phenols are unsubstituted or monoalkyl parasubstituted phenols and the preferred aldehydes are formaldehyde and its alkyl homologues, for example acetaldehyde and propionaldehyde. One particularly useful resin is Resinox R736, available from Monsanto Company, St. Louis, Mo.

The solvent is any liquid which acts as a solvent for the resin, is not reactive with either the resin or the propellant and which can be volatilized without further curing the resin or igniting the propellant. Suitable solvents include acetone, methanol, ethanol, propanol, isopropanol, benzene, toluene, chloroform, dichloromethane and the like.

Suitable plasticities include, for example, esters such as 2-ethylhexyl diphenyl phosphate p-t-butylphenyl diphenyl phosphate, and dioctyl adipate. The plasticizer may be added to the resin solution in an amount about 0.5 to 15 weight percent, based on the resin weight.

Suitable antioxidants include thiodipropionates such as dilauryl thiodipropionate, phenylene diamines such as di-$\beta$-naphthyl-p-phenylene-diamine, alkyl phosphites and the like, The antioxidant may be added to the resin solution in an amount about 0.1 to 1 weiqht percent based on the resin weight.

Suitable toughening agents include poly(vinyl acetate) and derivatives thereof, including poly(vinyl butyral), the latter being presently preferred. The toughening agent may be added to the resin solution in an amount ranging from about 5 to about 50 wt percent of the resin weight, preferably about 15 to 25 weight percent. When a toughening agent is employed, it is presently preferred that the resin solution also contain a plasticizer, preferably a phosphate ester plasticizer, in the amount stated above. The toughening agent, particularly when plasticized with a plasticizer, toughens and prevents cracking of the dried inhibitor layer on the propellant.

The following example illustrates the invention:

EXAMPLE

Propellant test strands measuring about 0.25-inch square were cut from a composite propellant containing a major amount of ammonium perchlorate. A series of test strands were coated with the materials given in Table I, below, then burned in a combustion chamber. An uncoated strand was also burned for comparison.

TABLE I

| Coating | Result |
|---|---|
| None | Considerable flashing |
| Lacquer* | Considerable flashing |
| Teflon** | Moderate flashing |
| Silicone Grease*** | Some flashing |
| Invention Inhibitor**** | Very little flashing; very little char |
| Sodium Silicate | Moderate char |

*Commercial fingernail Polish
**Teflon Coating Product 82808, a product of the A. W. Chesterton Co., Stoneham, MA 02180
***Stopcock grease
****35 g of Resinox R 736 in 100 ml acetone As seen in the above table, the inhibitor of this invention allowed very little flashing and only a small amount of char remained after the burn. Further, the inhibitor of this invention did not provide excessive smoking during the propellant burn, thereby preventing interference with optical probes.

A series of mixtures of Resinox R 736 in acetone was prepared to determine the optimum concentration of resin for the particular propellant composition under test. Each mixture was coated onto a test strand, the acetone was volatilized and the coated strands were burned in the test chamber at atmospheric pressure. The results are shown in Table II, below:

TABLE II

| Resin Conc. (g/ml) | Result |
|---|---|
| 0.32 | Slight flashing |
| 0.35 | No flashing; light flaking |
| 0.38 | Slight Flaking |
| 0.48 | Flaking |
| 0.63 | Heavy Flaking |

Various modifications may be made to the present invention without departing from the spirit and scope of the invention.

We claim:

1. A method for inhibiting the surface of a solid propellant grain which consists of the steps of:
(a) providing a solid propellant grain:
(b) providing a solution consisting essentially of a partially cured phenol-formaldehyde resin in a volatile solvent;
(c) coating the surface of said grain with a layer of said solution; and
(d) evaporating said solvent at a temperature below the curing temperature of said resin.

2. The method of claim 1 wherein said solution consists essentially of about 10 to 65 grams of resin per 100 ml of solvent.

3. The method of claim 1 wherein said solution further contains about 0 5 to 15 weight percent of plasticizer.

4. The method of claim 1 wherein said solution further contains about 0.1 to 1.0 weight percent of antioxidant.

5. The method of claim 2 wherein said solution further contains about 0.5 to 15 weight percent of plasticizer and about 0.1 to 1.0 weight percent of antioxidant.

6. The method of claim 2 wherein said solution contains about 15 to 40 grams of resin per 100 ml of solvent.

7. The method of claim 1 wherein said solution further contains about 5 to 50 weight percent of toughening agent.

8. The method of claim 7 wherein said toughening agent is poly(vinyl butyral).

9. The method of claim 7 wherein said solution further contains about 0.5 to 15 weight percent of plasticizer.

10. The method of claim 2 wherein said solution further contains about 0.5 to 15 weight percent of plasticizer, about 5 to 50 weight percent of toughening agent and about 0.1 to 1.0 weight percent of antioxidant.

* * * * *

UNITED STATES PATENT AND TRADEMARK OFFICE

CERTIFICATE OF CORRECTION

PATENT NO. : 5,000,885

DATED : March 19, 1991

INVENTOR(S) : Janet L. Laird et al

It is certified that error appears in the above-identified patent and that said Letters Patent is hereby corrected as shown below:

Col 1, line 14, "moor" should be -- motor --.
Col 1, line 16, a period should follow "surfaces".
Col 1, line 16, "present" should be -- Present --.
Col 1, line 40, "photograpy" should be -- photography --.
Col 1, line 55, the period should be a comma.
Col 1, line 56, "Preferably" should be -- preferably --.
Col. 2, line 44, a comma should follow "sample" (2nd occurrence);
Col 3, line 24, a period should follow "molecule".
Col. 3, line 35, "propenol" should be --propenyl--.
Col 3, line 46 a comma should follow both occurrences of "phenol".
Col 3, line 54, a comma should follow "acid".
Col 3, line 55, a comma should follow "acid".
Col 4, line 1, a comma should follow "example".
Col 4, line 11, "plasticities" should be -- plasticizers --.
Col 4, line 12, a comma should follow "phosphate".
Col 4, line 18, a comma should follow "phosphites".
Col 4, line 19, the comma should be a period.
Col 4, line 20, "weiqt" should be -- weight --.
Col 6, line 5, "0 5" should be -- 0.5 --.

Signed and Sealed this

Thirteenth Day of July, 1993

*Attest:*

*Attesting Officer*

Michael K. Kirk

MICHAEL K. KIRK

*Acting Commissioner of Patents and Trademarks*